US007938377B2

(12) United States Patent
Draghici et al.

(10) Patent No.: US 7,938,377 B2
(45) Date of Patent: May 10, 2011

(54) MARINE VEHICLE SEAT MOUNT

(75) Inventors: Adrian Draghici, Grand Prairie, TX (US); Kevin Downey, Grand Rapids, MI (US)

(73) Assignee: Brunswick Corporation, Lake Forest, IL (US)

( * ) Notice: Subject to any disclaimer, the term of this patent is extended or adjusted under 35 U.S.C. 154(b) by 458 days.

(21) Appl. No.: 12/100,879

(22) Filed: Apr. 10, 2008

(65) Prior Publication Data

US 2008/0251001 A1 Oct. 16, 2008

Related U.S. Application Data

(60) Provisional application No. 60/911,004, filed on Apr. 10, 2007.

(51) Int. Cl.
*B63B 17/00* (2006.01)

(52) U.S. Cl. ..... 248/429; 114/363; 297/344.1

(58) Field of Classification Search ..... 114/363; 297/344.1, 344.11; 248/420, 423, 429
See application file for complete search history.

(56) References Cited

U.S. PATENT DOCUMENTS

| | | | | |
|---|---|---|---|---|
| 3,186,761 | A | 6/1965 | Propst | |
| 4,010,926 | A | 3/1977 | Carnahan | |
| 4,928,620 | A | 5/1990 | Currey | |
| 5,131,718 | A | 7/1992 | Cooper | |
| 5,171,063 | A | 12/1992 | Stidd | |
| 5,374,102 | A | 12/1994 | Archambault et al. | |
| 5,833,385 | A | 11/1998 | Carnahan et al. | |
| 5,882,076 | A | 3/1999 | Garelick et al. | |
| 5,884,887 | A * | 3/1999 | Garelick et al. | 248/423 |
| 6,012,775 | A | 1/2000 | Czarnecki | |
| 6,082,680 | A | 7/2000 | Woodward et al. | |
| 6,098,937 | A | 8/2000 | Carnahan et al. | |
| 6,116,183 | A | 9/2000 | Crow et al. | |
| 6,293,622 | B1 * | 9/2001 | Horisawa | 297/344.1 |
| 6,325,456 | B1 | 12/2001 | Carnahan | |
| 6,460,818 | B1 * | 10/2002 | Garelick et al. | 248/420 |
| 6,733,084 | B2 | 5/2004 | Butler | |
| D497,274 | S | 10/2004 | Hogle et al. | |
| 6,799,803 | B1 | 10/2004 | Lee et al. | |
| 7,013,831 | B1 * | 3/2006 | Garelick | 114/364 |
| 2006/0082202 | A1 | 4/2006 | Gasser | |

* cited by examiner

*Primary Examiner* — Stephen Avila
(74) *Attorney, Agent, or Firm* — Hanley, Flight & Zimmerman, LLC

(57) ABSTRACT

A seat slider assembly is disclosed. The slider seat includes a seat mount and a first slider guide extending along at least a portion of the perimeter of the seat mount. A second slider guide extends from the surface of the seat mount at a position distally located from the perimeter of the seat mount. A slider plate to which a vehicle seat can be mounted includes a first channel for slidably engaging the first slider guide and a second channel for slidably engaging the second slider guide such that the slider plate is slidable between a first position and a second position relative to the seat mount. A locking lever is movably coupled to the slider plate and includes a locking structure to prevent the slider plate from moving relative to the seat mount. A control member operatively coupled to the locking lever to cause the locking lever to move toward an unlocked position wherein the locking structure allows the slider plate to move relative to the seat mount. In some examples, a trim piece is adapted to at least partially cover fasteners mounting the assembly to a vehicle support surface.

14 Claims, 7 Drawing Sheets

MARINE VEHICLE SEAT MOUNT

CROSS REFERENCE TO RELATED APPLICATION

This application is a non-provisional application claiming priority from U.S. Provisional Application Ser. No. 60/911,004, filed Apr. 10, 2007, and incorporated herein by reference in its entirety.

FIELD OF THE DISCLOSURE

The present disclosure relates generally to vehicle seats and more particularly to a marine vehicle seat mount.

BACKGROUND OF RELATED ART

Many vehicle seats such as those used in boats include a swiveling and/or sliding seat mount coupled to a post and base assembly in the boat. A swiveling or sliding seat mount enables a seated vehicle occupant to rotate and/or slide their seat to a desired position, which typically occurs when the vehicle is relatively stationary to enable, for example, an operator of the vehicle (e.g., a driver) to adjust the position of their seat for use of vehicle controls, comfort, safety, etc.

Sliding seat assemblies have included a slider plate slidably coupled to a base mount. The slider plate typically includes a flange adapted to slide on the perimeter of the base mount. With a perimeter flange, however, stability and precision in operation may be an issue. In the case of boats, for example, stability and/or precision in operation may affect the comfort of the operator of the boat. In particular, any movement of the vehicle seat may result in operator discomfort.

Additionally, seat assemblies typically include a structure such as, for example, a pedestal, that is connected to the floor of the vehicle to secure the entire seat assembly to the vehicle floor. For example, in some instances the pedestal includes a bell assembly that is bolted to the vehicle floor to provide a secure mounting base for the seat. While bolting the bell assembly to the vehicle floor provides a relatively permanent connection, it may be desirous to remove the bolts at a later date to allow the assembly to be serviced, and/or replaced.

Exposing the bolts used to secure the bell assembly includes a number of drawbacks. In particular, the bolts are oftentimes directly exposed to the elements, including water, which may result in the oxidation of the bolts and result in great difficulty in removing the bolts. Additionally, the exposed bolts may be unsightly as they may appear unfinished.

DETAILED DESCRIPTION

Figure 1:
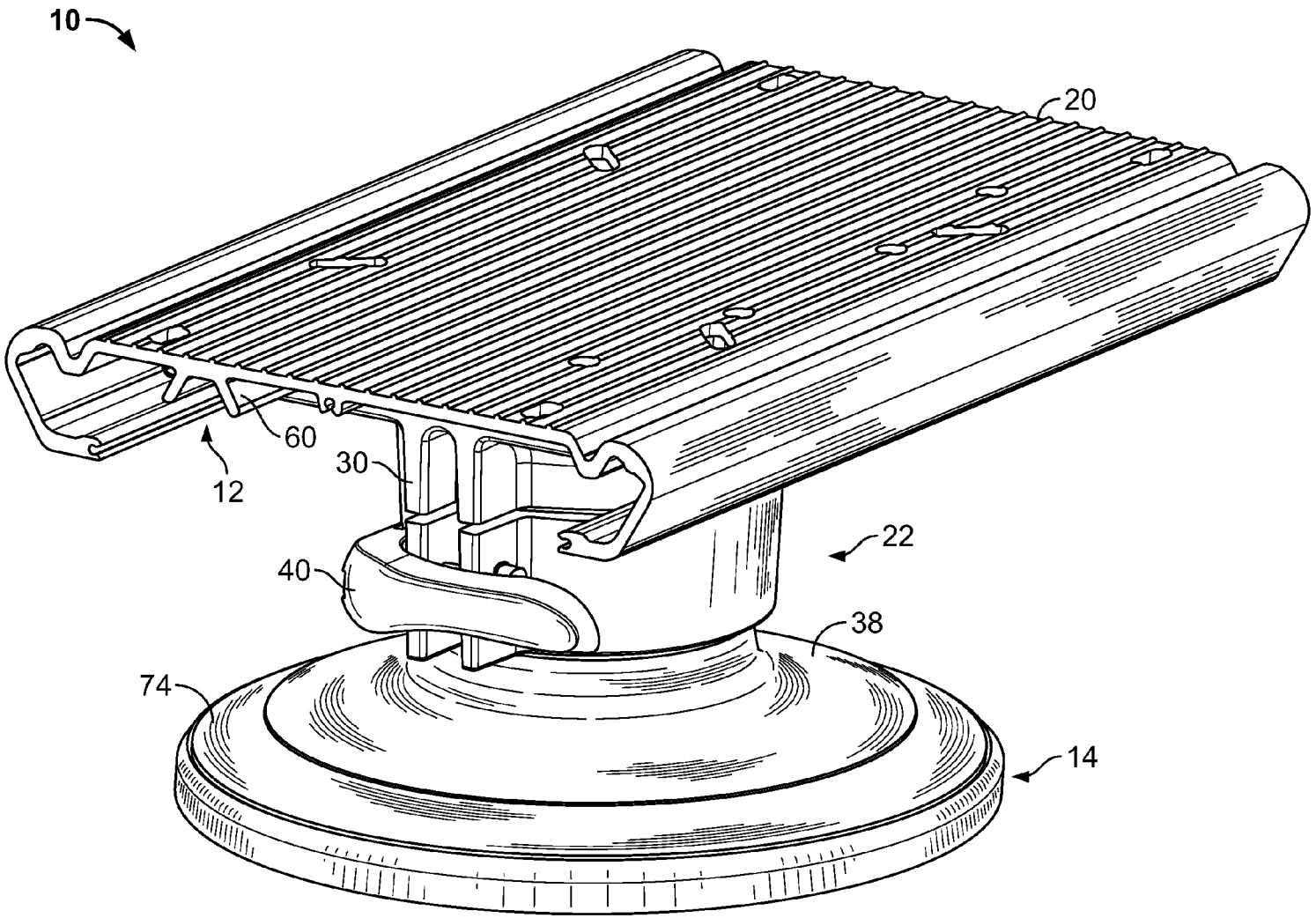
FIG. 1 depicts an example vehicle seat mount showing an example v-shaped slider guide and an example base bell including a trim ring.
Figure 2:
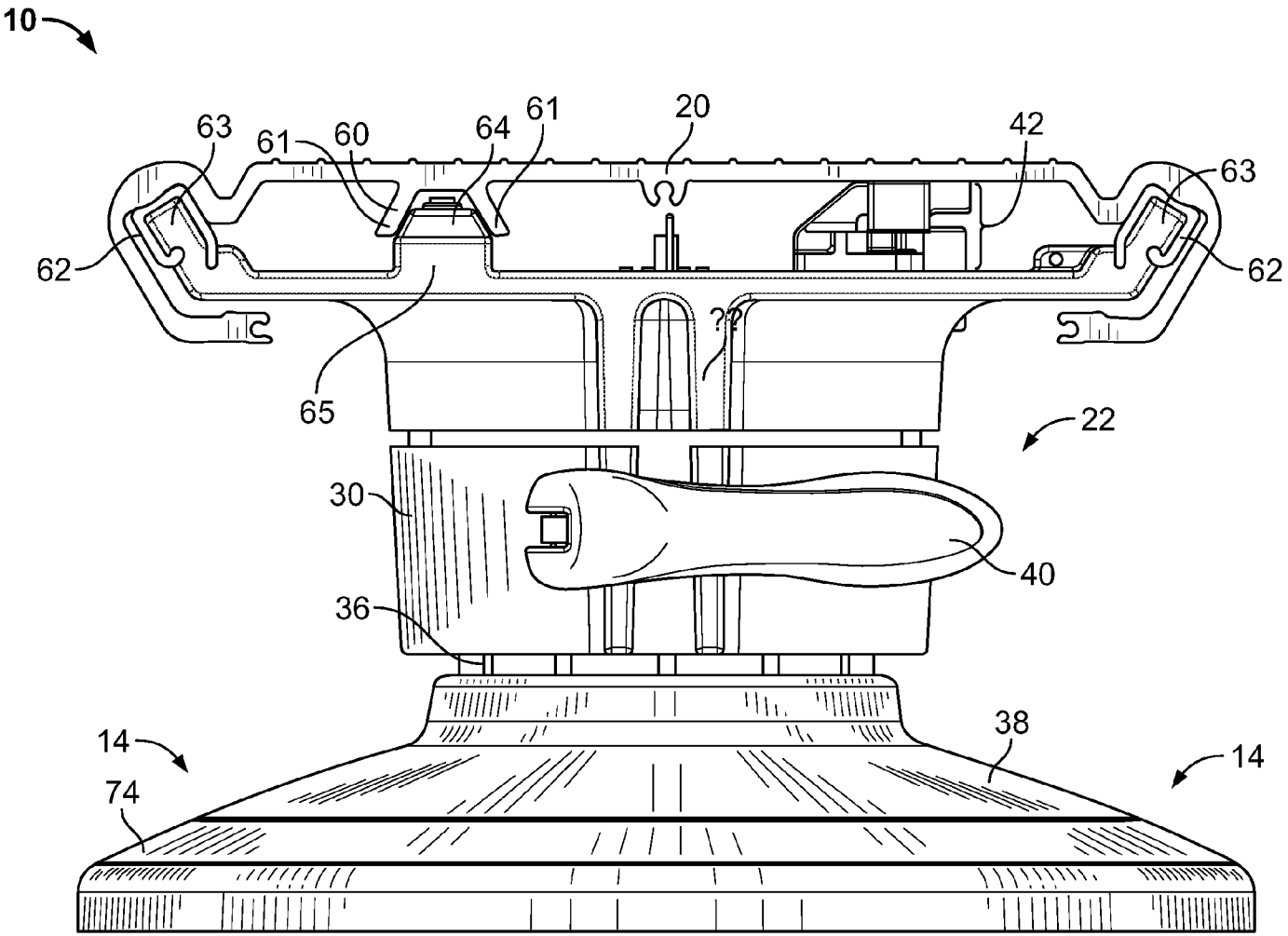
FIG. 2 is a front elevational view of the example vehicle seat mount of FIG. 1.
Figure 3:
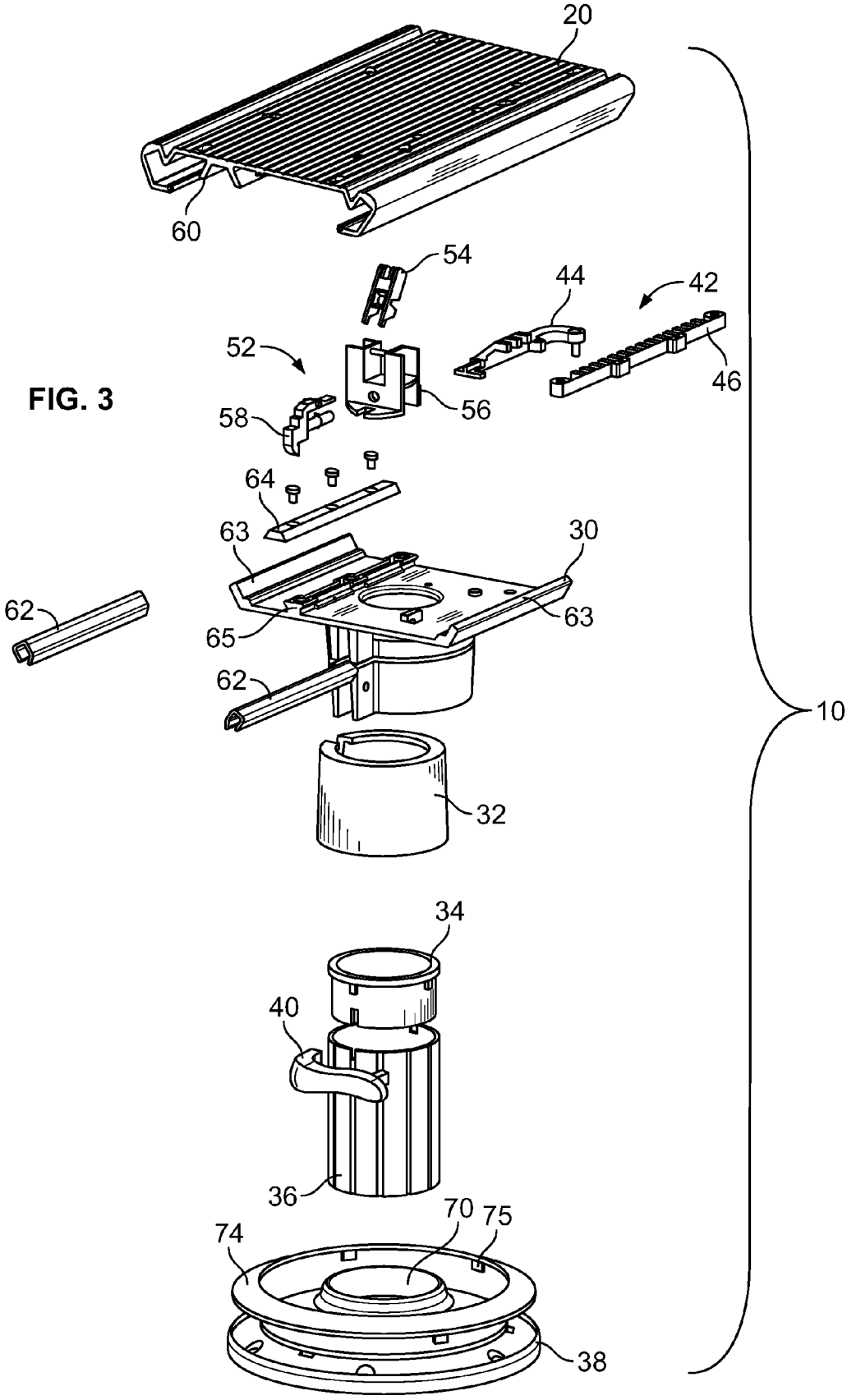
FIG. 3 is an exploded view of the example vehicle seat mount of FIG. 1.

FIGS. 1-3 depict an example vehicle seat mount assembly 10 including an example v-shaped slider glide 12 and an example base bell trim cover 14 described herein. Referring to FIGS. 1-3, a vehicle seat (not shown) is coupled or mounted to the example vehicle seat mount assembly 10 via a pedestal slider plate 20. The slider plate 20 is, in turn, slidably coupled to a support stand 22, which, in turn, may be coupled or fixed to a floor surface of a vehicle (not shown). The example support stand 22 generally includes a seat mount 30, a seat mount bushing 32, a tube top bushing 34, a tube pedestal 36, and a base bell 38.

The vehicle seat mount assembly 10 may be configured for use in any desired type of vehicle including, for example, a boat, a car, a recreational vehicle, heavy equipment, etc. Additionally, the vehicle seat may be configured (e.g., sized, shaped, utilizes materials, etc.) to suit the particular vehicle in which the example vehicle seat mount assembly 10 is to be mounted.

The example vehicle seat mount assembly 10 includes an operating lever 40 operatively coupled to the seat mount 30 to increase and/or decrease the pressure applied by the seat mount 30 on the seat mount bushing 32. Additionally, the seat mount assembly 10 includes an actuating mechanism (not shown) that is operatively coupled to a seat slider mechanism 42, such as, for example, via a flexible coupling (not shown). In this example, the seat slider mechanism 42 includes a locking lever 44 and a lock rail slider 46. The actuating mechanism may be manually actuated by an occupant of the vehicle seat to enable the vehicle seat to freely slide or move in a generally fore/aft direction or axis with respect to the vehicle in which the vehicle seat mount assembly 10 is mounted. The seat slider mechanism 42 and/or the actuating mechanism may include resilient or springably biased member(s) to bias the slider mechanism 42 in a locked condition. Thus, actuation of (e.g., manual application of a force to) the actuating mechanism by a person works against the bias to cause the example seat slider mechanism 42 to unlock, thereby enabling the vehicle seat and in particular, the slider plate 20 to slidably move relative the support stand 22. Then, when the actuating member is released by the person (i.e., the person ceases to apply force to the actuating member), the resilient or springably biased member(s) cause the example seat slider mechanism 42 to automatically return to the locked condition.

The example slider plate 20 includes a flange 61, or a pair of flanges 61 forming a channel portion 60, slidably mountable over a slider guide such as, for instance, slider guides 62 and/or slider guide 64. The slider guides 62 extend along at least a portion of the perimeter of the seat mount 30 and the slider guide 64 extends from the surface of the seat mount 30 substantially parallel to the slider guides 62. The slider guides 62 and the slider glide 64 may be fixed to (e.g., integrally and/or removably formed with) the seat mount 30, and may be separately formed and mounted to the seat mount 30. For example, in the illustrated example, the slider guides 62 and 64 are separately formed and mounted over lips 63 and/or an extension 65 extending from the generally planar surface of the seat mount 30. In this example, the slider glide 64 is coupled to the extension 65 by, for example, a plurality of fasteners secured through apertures defined by the slider glide 64 to the seat mount 30, while the slider guides 62 are frictionally fitted to the lips 63.

In this example, to assist in the stability and precision of the slider plate 20 as it slides relative to the seat mount 30, the channel portion 60 of the slider plate 20 is generally flared shaped and slides over the slider guide 64, which is reciprocally designed to accept the flared channel portion 60. It will be appreciated, however, that the channel portion 60 and slider glide 64 may be manufactured in any suitable shape, including, for example, a tapered channel shape illustrated below.

The example vehicle seat assembly 10 also includes a seat swivel mechanism 52 operatively selectable to allow the seat mount 30 to axially pivot, or swivel, about the tube pedestal 36. In this example, the seat swivel mechanism 52 includes a swivel lock lever 54, a locking base 56, and a locking pin 58. A swivel actuating mechanism (not shown) is operatively coupled to a swivel lock lever 54, such as, for example, via a flexible coupling (not shown). Thus, actuation of the swivel actuating mechanism by a person enables the vehicle seat to freely pivot with respect to the vehicle tube pedestal 36 and in particular, to pivot through the bushings 32 and 34.

Figure 4:
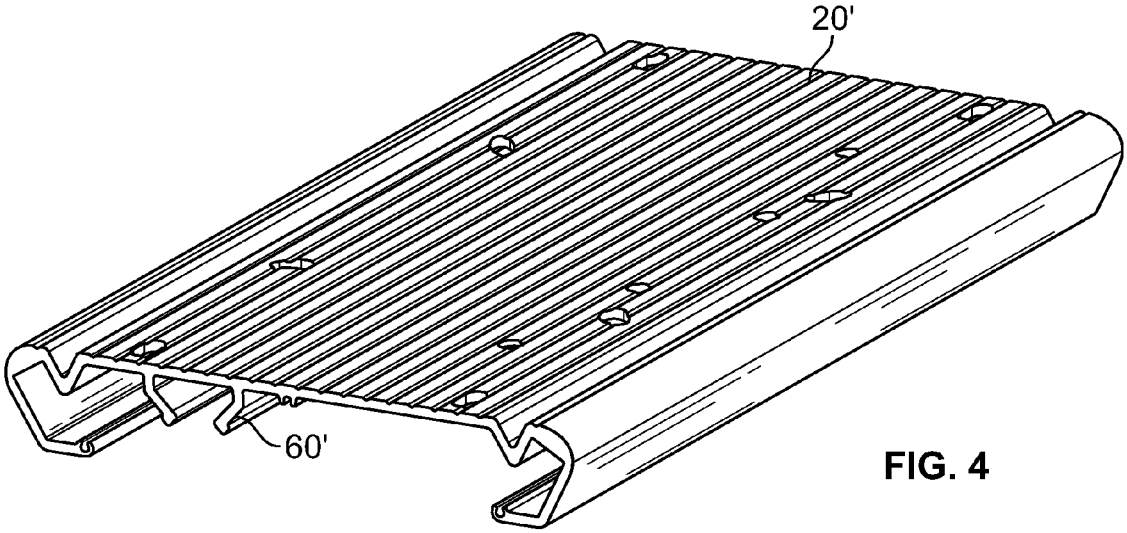
FIG. 4 is front perspective view of an example pedestal slider showing another example channel portion.
Figure 5:
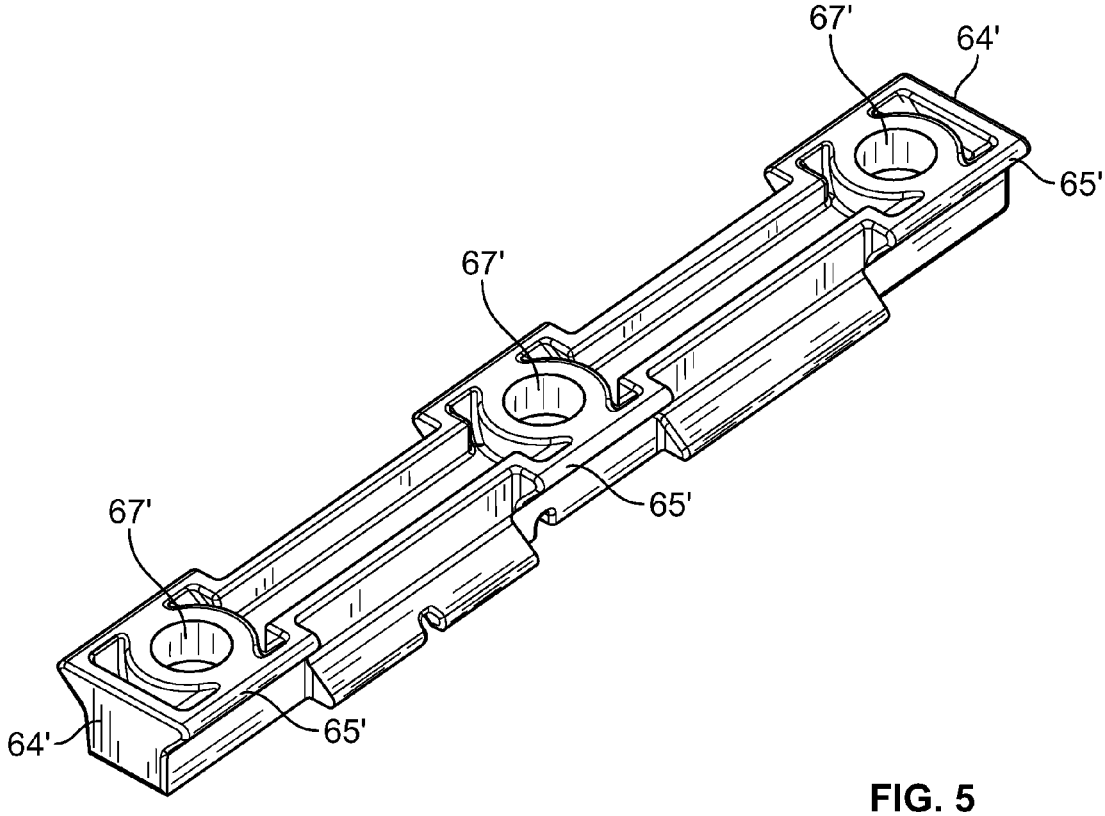
FIG. 5 is a front perspective view of an example slider glide for use with the pedestal slider of FIG. 4.
Figure 6:
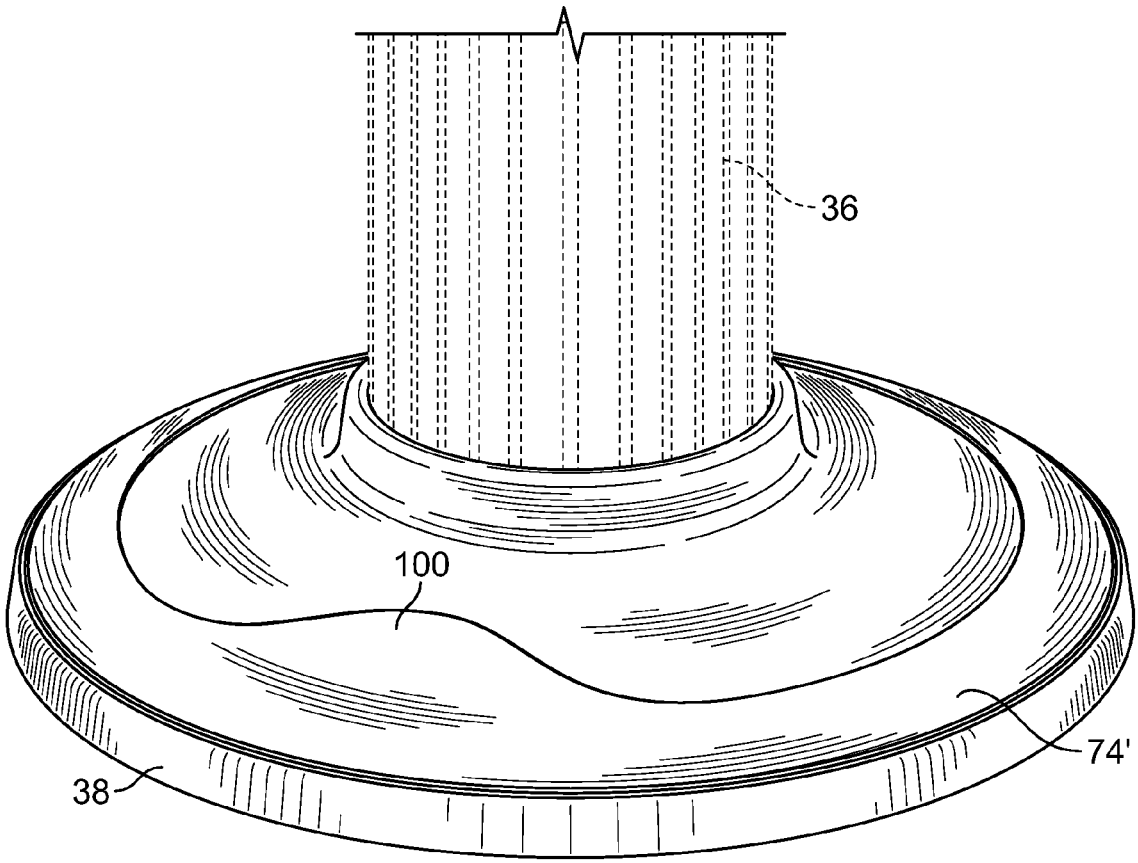
FIG. 6 is an enlarged view of the base bell of FIG. 1, showing another example trim ring.
Figure 7:
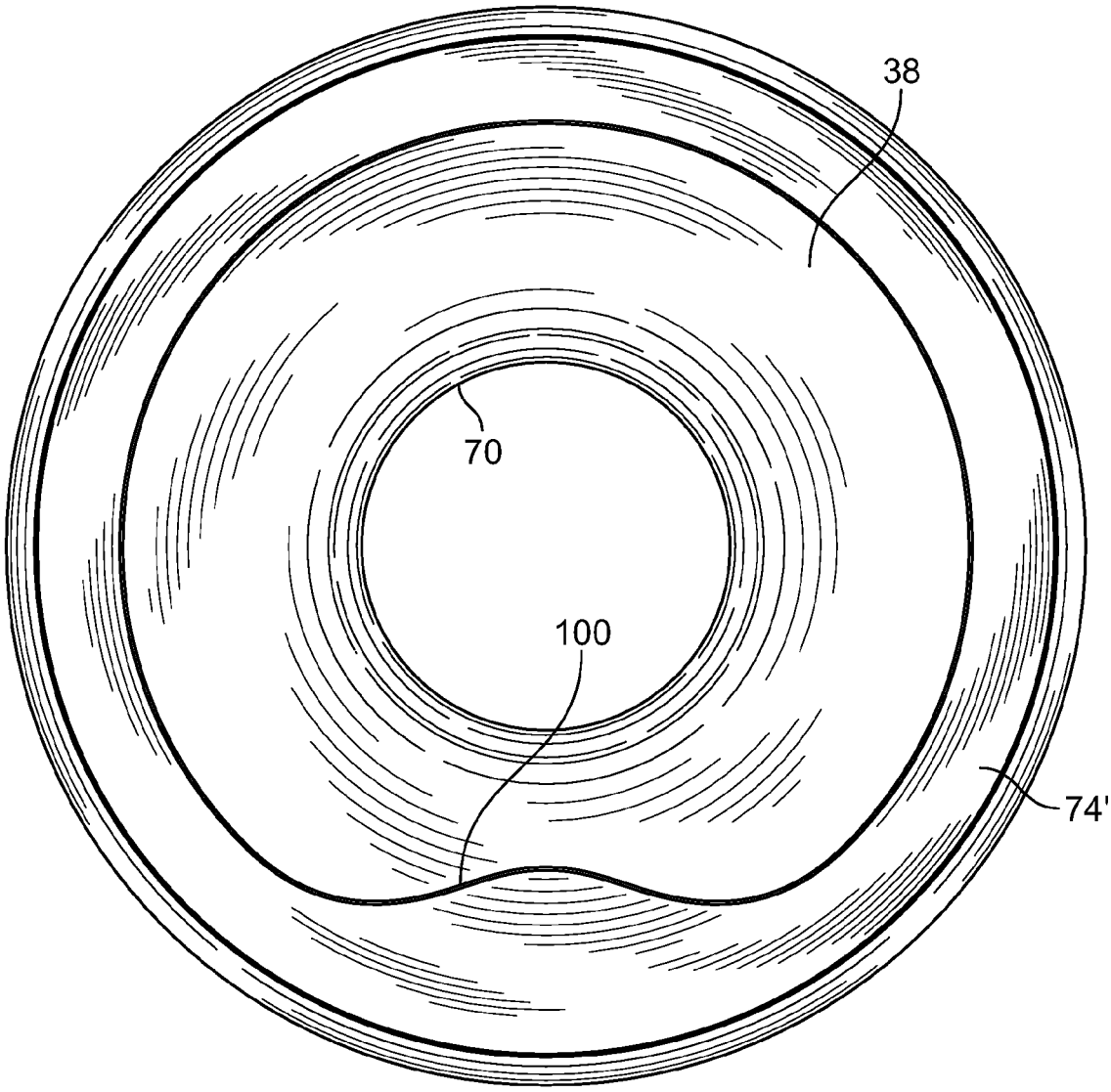
FIG. 7 is a plan view of the example base bell of FIG. 6.
Figure 8:
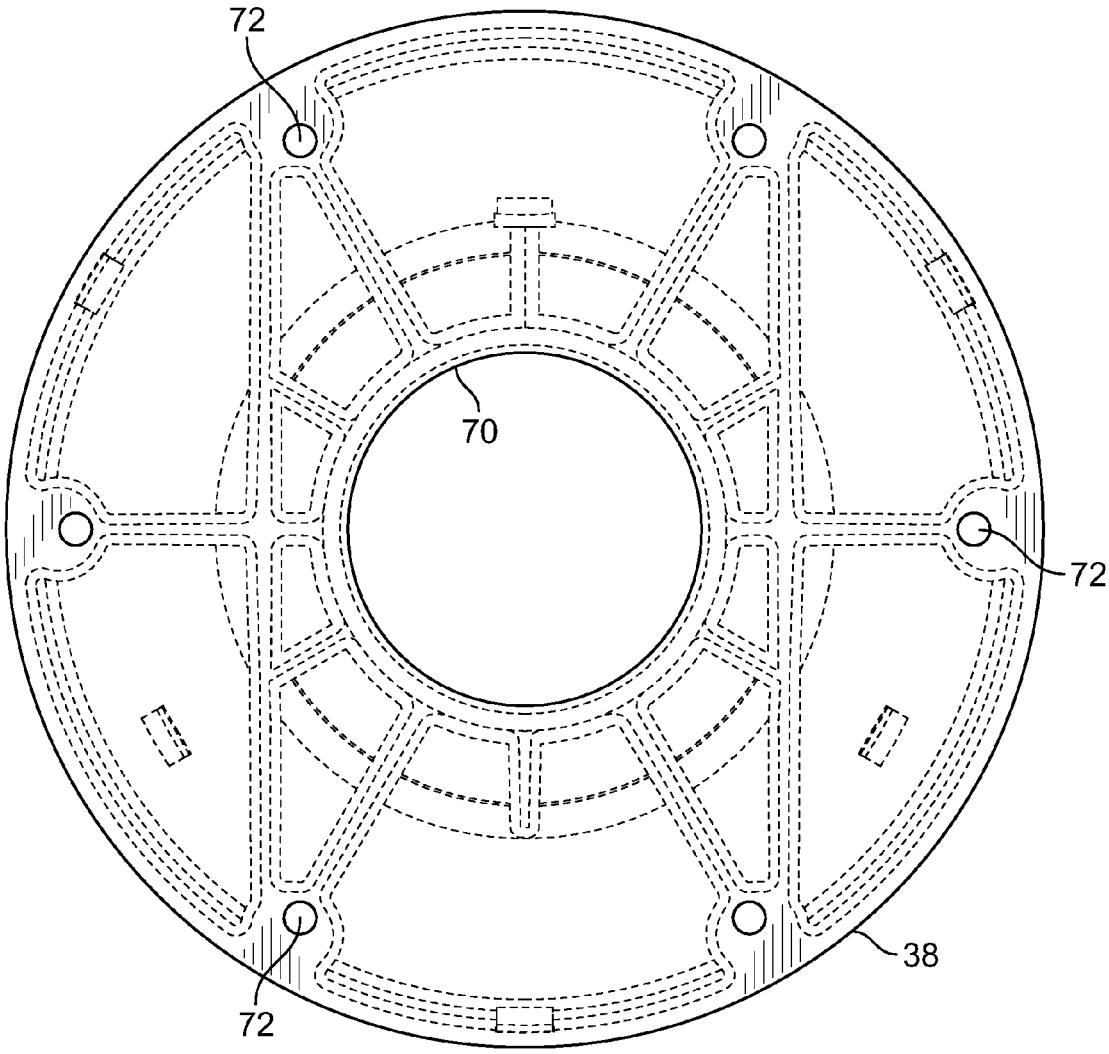
FIG. 8 is a bottom side view of the example base bell of FIG. 6.
Figure 9:
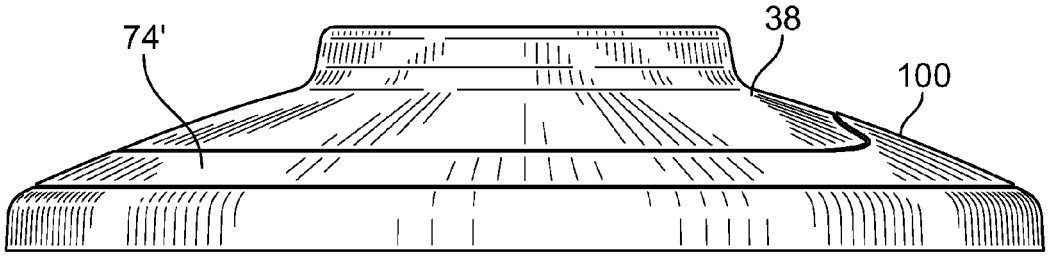
FIG. 9 is a side elevational view of the example base bell of FIG. 6.

Referring to FIGS. 4 and 5, there is illustrated another example slider plate 20' and slider glide 64' that may be used in conjunction with the vehicle seat 10 of FIGS. 1-3. In this example, a channel portion 60' of the slider plate 20' is generally tapered shaped and is adapted to slide over the reciprocally designed slider glide 64', similar to the previous example. As can be seen in FIG. 4, the slider glide 64' includes a first flared surface 65' that is adapted to mate with the channel portion 60'. In this example the slider glide 64' includes a plurality of distinct flared surface portions 65', but it will be understood that the flared surface portion may extend partially, or fully along the length of the slider glide 64'. Similar to the slider glide 60, the slider glide 64' is adapted to be mountable to the seat mount 30 through, for example, fasteners extending through defined apertures 67'. Furthermore in this example, the flared/tapered mating of the slider plate 20' and the slider glide 64' may assist in preventing the slider plate 20' from moving vertically (i.e., away from) the slider glide 64' and, thus, the seat mount 30.

Returning to FIGS. 1-3, as noted above, the example base bell 38 is adapted to couple and/or fix the support stand 22 to a floor surface of a vehicle. For example, in this instance, the base bell 38 defines an aperture 70 sized to accept and/or secure the tube pedestal 36. Additionally, the base bell 38 includes a plurality of apertures 72 sized to accept a respective fastener (e.g., a bolt (not shown)) to securely couple the base bell 38 to the floor surface.

Because the fasteners extend through the base bell 38 into the floor surface to secure the base bell 38 thereto, a portion of the fasteners may be exposed to the environment along the top surface of the base bell 38. Therefore, in this example, the base bell 38 is also adapted to retain at least one trim ring 74 to at least partially cover the apertures 72 and therefore cover and/or protect the fasteners utilized to secure the base bell 38 to the floor surface. The trim ring 74 may be, for example, a thermoplastic (or other material) ring having a plurality of tabs 75 (or other structures) adapted to interference (or otherwise) fit with corresponding structures on the base bell 38. It will be appreciated that the trim ring 74 may be manufactured with any suitable material and may utilize any suitable fastening method to mount to the base bell. The trim ring 74 may also completely cover the apertures 72, and may assume any shape and/or size, such as, for example, any decorative ring shape. Furthermore, the trim ring 74 may be manufactured and/or secured as a single trim ring to cover all apertures 72, or may alternatively comprise any number of separate trim covers, such as, for example, a separate cover for each and/or some of the apertures 72.

Turning now to FIGS. 6-9, there is illustrated another example trim ring 74' and base bell 38 combination. In this example, the trim ring 74' may be decorated as desired and may include any number of different designs and/or shapes. For instance, the trim ring 74' may include at least a decorative design element 100. The decorative design element 100 in this example includes both the trim ring 74' and an oval-shaped extension. It will be appreciated, however, that the design of the trim ring 74' element 100 may be varied as desired.

Although certain apparatus have been described herein, the scope of coverage of this patent is not limited thereto. To the contrary, this patent covers all apparatus fairly falling within the scope of the disclosure.

We claim:

1. A seat mounting assembly comprising:

a seat mount;

a slider guide extending along at least a portion of the seat mount;

a slider plate to which a vehicle seat can be mounted, the slider plate including a first flange for slidably engaging the slider guide such that the slider plate is slidable between a first position and a second position relative to the seat mount;

a locking lever movably coupled to the slider plate and including a locking structure, wherein the locking structure is shiftable between a locked position in which the locking structure prevents the slider plate from moving relative to the seat mount, and an unlocked position, in which the locking structure allows the slider plate to move relative to the seat mount;

a control member operatively coupled to the locking lever to cause the locking lever to move between the locked position and the unlocked position;

a support stand mountable to a surface of a vehicle and adapted to support the seat mount a distance from the vehicle surface, wherein the support stand includes:

an aperture, wherein the support stand is mountable to the vehicle surface by a fastener inserted through the aperture;

a generally circular base bell; and a tubular pedestal extending from the base bell and adapted to support the seat mount; and a trim piece adapted to at least partially cover the fastener and aperture, and the trim piece includes a tab to interference fit the trim piece to the base bell.

2. A seat mounting assembly as defined in claim 1, wherein the trim piece is a trim ring.

3. A seat mounting assembly as defined in claim 1, wherein the trim piece extends substantially along a radial circumference of the base bell.

4. A seat mounting assembly as defined in claim 1, wherein the trim piece is a thermoplastic.

5. A seat mounting assembly as defined in claim 1, wherein the slider guide is a first slider guide and the seat mounting assembly further comprising:

a second slider guide extending from the surface of the seat mount at a position distally located from the perimeter of the seat mount and substantially parallel to the first slider guide; and a second flange extending from the slider plate for slidably engaging the second slider guide.

6. A seat mounting assembly as defined in claim 5, wherein at least one of the first flange or the second flange defines a flared channel.

7. A seat mounting assembly as defined in claim 5, wherein at least one of the first flange or the second flange defines a tapered channel.

8. A seat mounting assembly as defined in claims 1, wherein, the slider plate includes a first channel and a second channel for slidably engaging the slider guide.

9. A seat mounting assembly as defined in claim 5, further comprising a third slider guide mounted to the seat mount and extending along at least a portion of the perimeter of the seat mount opposite the first slider guide.

10. A seat mounting assembly as defined in claim 8, wherein the second channel includes a flared portion and the slider guide is reciprocally designed to accept the flared portion of the second channel.

11. A seat mounting assembly as defined in claim 8, wherein the second channel includes a tapered portion and the slider guide is reciprocally designed to accept the tapered portion of the second channel.

12. A seat mounting assembly as defined in claim 1, wherein the first slider guide is integrally formed with the seat mount.

13. A seat mounting assembly as defined in claim 5, wherein the second slider guide is integrally formed with the seat mount.

14. A seat mounting assembly as defined in claim 5, wherein the second slider guide is mounted to a lip extending from the surface of the seat mount.

* * * * *